US005265901A

United States Patent [19]

Gorza

[11] Patent Number: 5,265,901

[45] Date of Patent: Nov. 30, 1993

[54] HEEL UNIT FOR SKI BINDINGS WITH AUTOMATIC RESET MEANS

[75] Inventor: Roberto Gorza, Feltre, Italy

[73] Assignee: Nordica S.p.A., Montebelluna, Italy

[21] Appl. No.: 965,325

[22] Filed: Oct. 23, 1992

[30] Foreign Application Priority Data

Nov. 8, 1991 [IT] Italy ..... MI91A002974

[51] Int. Cl.[5] ..... A63C 9/085; A63C 7/10

[52] U.S. Cl. ..... 280/632; 280/605; 280/634

[58] Field of Search ..... 280/605, 631, 632, 633, 280/634, 636

[56] References Cited

U.S. PATENT DOCUMENTS

| | | | |
|---|---|---|---|
| 4,168,083 | 9/1979 | Storandt | 280/605 |
| 4,496,167 | 1/1985 | Krob et al. | 280/605 |

FOREIGN PATENT DOCUMENTS

| | | | |
|---|---|---|---|
| 2635155 | 2/1978 | Fed. Rep. of Germany | 280/605 |
| 2707771 | 8/1978 | Fed. Rep. of Germany | 280/605 |
| 2707772 | 8/1978 | Fed. Rep. of Germany | 280/605 |
| 2855343 | 7/1979 | Fed. Rep. of Germany | 280/605 |
| 3611761 | 7/1987 | Fed. Rep. of Germany | 280/605 |
| 2548031 | 1/1985 | France | 280/634 |

*Primary Examiner*—Brian L. Johnson

*Attorney, Agent, or Firm*—Guido Modiano; Albert Josif

[57] ABSTRACT

A heel for ski bindings with an automatic reset device, including a heel unit body which can be fixed to a ski and supports a ski boot grip jaw, a kinematic system acting on said grip jaw; the kinematic system is connected to a spring which can be calibrated so as to removably retain the grip jaw in ski boot securing position. A pedal interacts with the ski boot for actuating the kinematic system to open the grip jaw when the ski boot separates from the binding.

12 Claims, 4 Drawing Sheets

HEEL UNIT FOR SKI BINDINGS WITH AUTOMATIC RESET MEANS

BACKGROUND OF THE INVENTION

The present invention relates to a heel unit for ski bindings with automatic reset means.

Heel units with automatic reset are heel units in which, upon the safety release of the ski boot from the binding, the heel unit automatically arranges itself in the open position, ready for a new coupling to the ski boot, both if release has occurred by means of the opening of the toe unit and if it has occurred by means of the opening of the heel unit.

Heel units with automatic reset, which were introduced some time ago, were based substantially on the concept that the heel unit, when the ski boot was no longer present on the binding, moved toward the front part of the ski, causing the rear jaw to open and to preset itself for a new coupling.

This type of solution has had few practical applications, because it was extremely difficult to calibrate the binding and undue openings of the rear jaw could occur due to the movement of the heel unit caused by the flexing of the ski or due to the incorrect adjustment of the adaptation of the binding to the length of the sole of the boot.

Heel units with automatic reset of the above described type were also structurally very complicated as well as scarcely reliable, due to the large number of component elements which constituted them.

Another problem which occurs in ski bindings is related to the timely actuation of the ski braking element upon the release of the boot from the binding; in order to solve this problem, the U.S. Pat. No. 4,168,083 describes a heel unit wherein the ski brake is actuated directly by the heel unit both if release from the binding has occurred due to opening on the toe unit and if it has occurred due to opening on the heel unit.

The embodiment described in the above mentioned patent, and specifically the embodiment illustrated in FIGS. 1 to 4, discloses an interaction between the rear jaw and the brake which causes the jaw to actuate the brake for any type of release but does not automatically open the rear jaw and does not reset it, if the release action has occurred due to the opening of the toe unit.

SUMMARY OF THE INVENTION

The aim of the present invention is to solve the above described problems by providing a heel unit for ski bindings with automatic reset means, wherein automatic reset is not produced by the movement of the heel unit but by means of an element which is operatively interconnected with the heel unit and is directly controlled by the presence or absence of the ski boot on the binding.

Within the scope of the above aim, a particular object of the invention is to provide a heel unit which integrates a ski brake which is operatively interconnected to the heel unit and, besides being extracted automatically when the ski boot separates from the binding, causes the opening of the heel unit independently of the fact that release has occurred by means of the opening of the toe unit or of the heel unit.

Another object of the present invention is to provide a heel unit for ski bindings wherein the particular means used for automatic reset are in no way affected by the calibration of the release force of the heel unit or by the flexures which occur in the ski during ordinary skiing or by the adjustment of the binding to the length of the sole of the boot.

A further object of the present invention is to provide a heel unit which is constituted by a reduced number of component elements which have a simplified assembly.

The above aim, the objects mentioned and others which will become apparent hereinafter are achieved by a heel unit for ski bindings with automatic reset means, according to the appended claims.

BRIEF DESCRIPTION OF THE DRAWINGS

Further characteristics and advantages will become apparent from the description of a preferred but not exclusive embodiment of a heel unit for ski bindings with automatic reset means, according to the invention, illustrated only by way of non-limitative example in the accompanying drawings, wherein.

DESCRIPTION OF THE PREFERRED EMBODIMENTS

Figure 2:
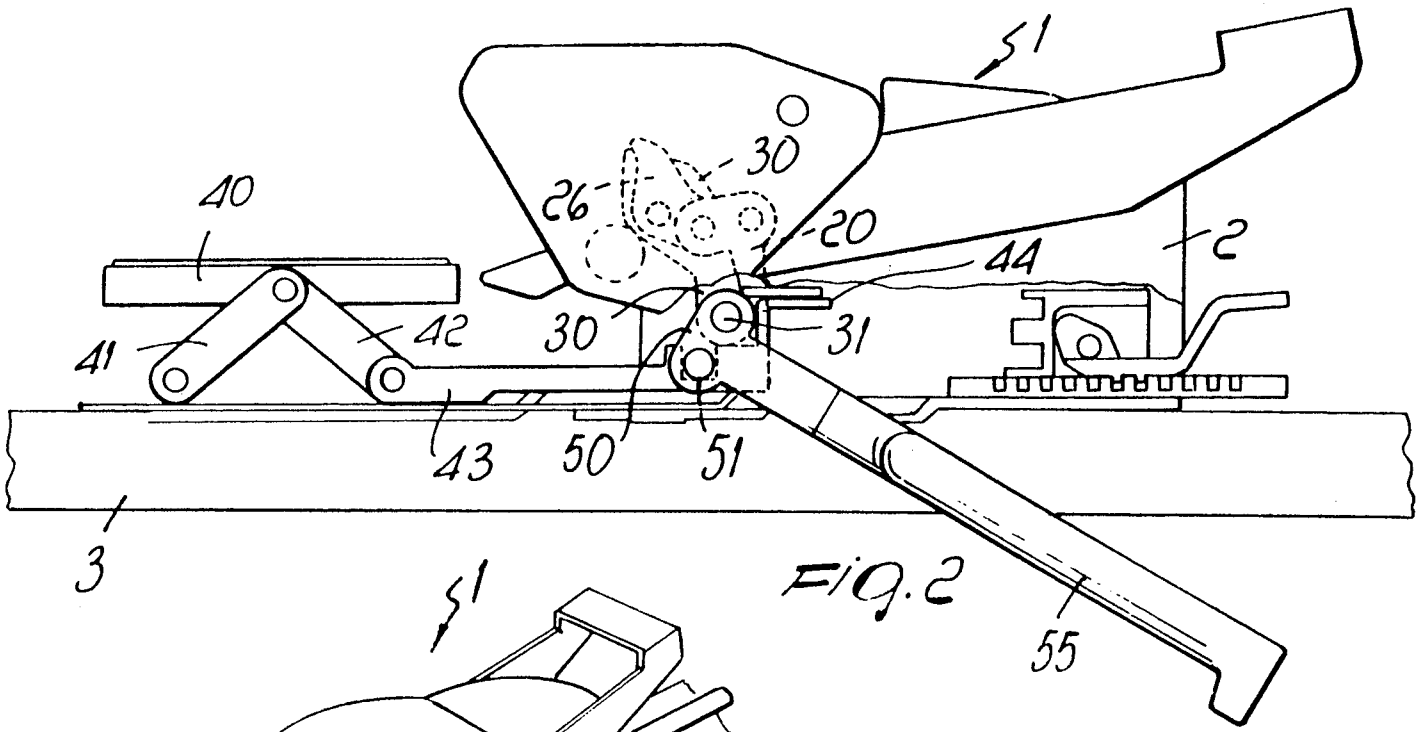
FIG. 2 is a schematic lateral elevation view of the heel unit.
Figure 1:
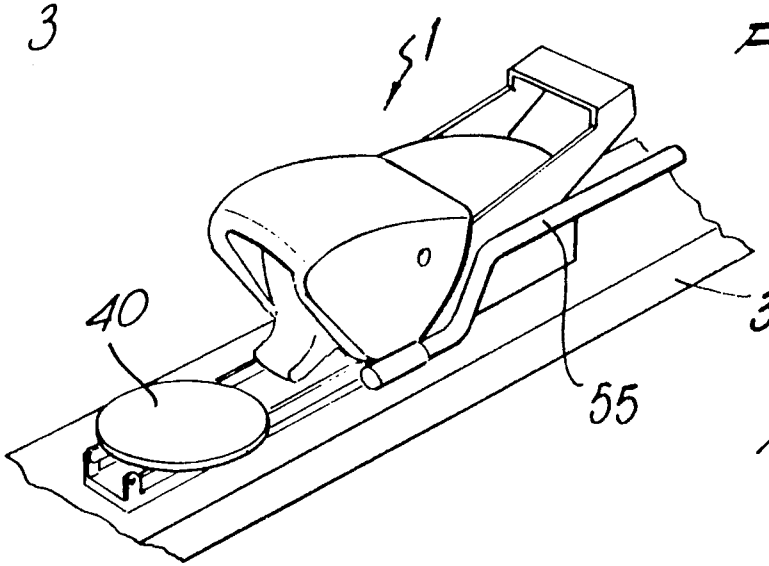
FIG. 1 is a schematic perspective view of the heel unit for ski bindings according to the invention.

With reference to the above figures, the heel unit for ski bindings with automatic reset means, according to the invention, which is generally designated by the reference numeral 1, comprises a heel unit body 2 which can be fixed in a per se known manner to a ski which is generally designated by the reference numeral 3.

The coupling can be provided by conventional means which allow to obtain a preset longitudinal arrangement of the heel unit 1.

The heel unit body 2 rotatably supports the grip jaw 5 and a piston 4 which is pushed by calibratable elastic mean constituted by a thrust spring 6 which interacts between said piston 4 and an adjustment body 7 controlled by the adjustment screw 8.

Calibration of the compression of the thrust spring 6 allows to calibrate in a per se known manner the release force required to open the grip jaw 5.

Said grip jaw 5 is, as mentioned, pivoted to the heel unit body 2 by means of a pivot 10 with which a torsion spring 11 is associated; said torsion spring engages the heel unit 5 in order to impart a lifting force which is directed upward, i.e. in the direction of the opening of the heel unit.

The grip jaw 5 supports a cam follower roller 12 which engages the opening kinematic system, generally designated by the reference numeral 15.

The opening kinematic system comprises an angular lever 20 having a median portion which is pivoted to the piston at 21.

Said lever 20 has an active arm 20*a* which abuts, in securing position, against an abutment element 22, arranged on the piston 4, which determines the arrangement of the angular lever 20. The interconnection arm 20*b* of the lever 20 is articulated at 25 to an intermediate reset lever 26 which is pivoted at 27 to the upper end of a contoured opening lever 30 which is pivoted at a lower portion as, at 31, to the heel unit body 2. Said contoured lever 30 has, toward the front part which is directed toward the toe unit, a securing indent, designated by 30*a*, which blends upward with an opening portion 30*b*. The above described levers are pivoted about axes which are mutually parallel and substantially perpendicular to the longitudinal extension of the ski.

When the jaw is in closed position for securing the ski boot, the point 25 for the common pivoting of the arm 20*b* of the angular lever 20 and of the end of the intermediate reset lever 26 is arranged below the line which joins the pivoting point 21 of the angular lever and the point 27 for the common pivoting of the intermediate reset lever and the contoured opening lever.

In these conditions, since the angular lever is in the abutment position due to its engagement with the abutment element 22 associated with the piston, any thrusts acting on the heel unit cannot cause the rotation of the levers 20 and 26 with respect to one another, and any possible forces can cause, as is typical in heel units of ski bindings, the translatory motion of the piston 4 in contrast with the thrust spring 6.

Because of the shape of the contoured lever, those forces can cause movements which are compensated, keeping the jaw in closed position, until the roller 12 acts in the indented region 30*a* of the lever 30.

When the stress is such that the cam follower roller 12 moves beyond the indent 30*a* and can engage the opening portion 30*b*, the grip jaw 5, pushed by the torsion spring 11, opens upward.

An important peculiarity of the invention is constituted by the fact that there are automatic reset means which are controlled by actuation means which advantageously but not necessarily also actuate the brake.

More in detail, there is a pedal 40 which is arranged substantially at the heel portion of the ski boot 9 and is supported at the end of a first lever 41 which is pivoted, at one end, to the base of the heel unit and is articulated, at the other end, to the pedal 40 and to a second lever 42. Second lever 42 is in turn pivoted to an arm 43 which can slide longitudinally along the ski. Arm 43 is connected to a slider 44 which is elastically pushed by an extraction spring, indicated by 45. Spring 45 performs a thrust action on the slider in order to raise, i.e. space, the pedal 40 from the ski when the weight of the ski boot does not bear thereon.

Advantageously, there is a brake plate, indicated by 50, which is pivoted at the pivoting point 31 of the lever 30 and engages a recess 51 defined either on the linking arm 43 or on the slider 44. Slider 44 can move so as to cause the rotation and extraction of the brake arm 55 which is connected to the brake plate 50 when the pedal 40 is raised.

A pawl 60 is also supported on the slider 44, is pivoted at a median portion indicated by 61 and is provided with an active wing 62. Active wing 62 is suitable for interacting, as will become apparent hereinafter, with the active arm 20*a* of the lever 20 when the slider 44 moves in one direction. An elastic thrust blade 65 acts on the side of the pawl 60 which is opposite to the one provided with the active wing 62, is supported by the heel unit body 2 and engages a planar thrust portion 66 of the pawl 60, which is arranged in front of the pivoting point 61 with reference to the arrangement on the ski, and a rear return portion 67, arranged behind the point 61, which in practice causes the rotation of the pawl about an axis which is substantially perpendicular to the plane of arrangement of the ski so as to disengage it from the region of arrangement of the active arm 20*a* of the angular lever 20.

In practical use, with reference to FIG. 3, when the ski boot is in securing position, the grip jaw 5 is in closed position, the pedal 40 is lowered and the extraction spring 45 is compressed to its maximum value, the kinematic system is in closed position, with the point 25 below the line which joins the points 21 and 27.

Figure 4:
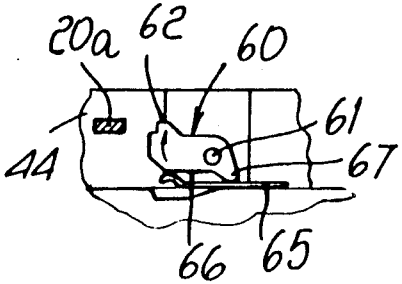
FIG. 4 is a top plan view of the detail of the pawl connected to the slider associated with the actuation means.

The wing 62 of the pawl 60, as shown in FIG. 4, is spaced from the active arm 20*a* by a preset extent.

Said spacing is caused by the fact that any flexures which are exerted on the ski, or in any case any movements within a range considered still safe, must not cause the opening of the heel unit.

Figure 5:
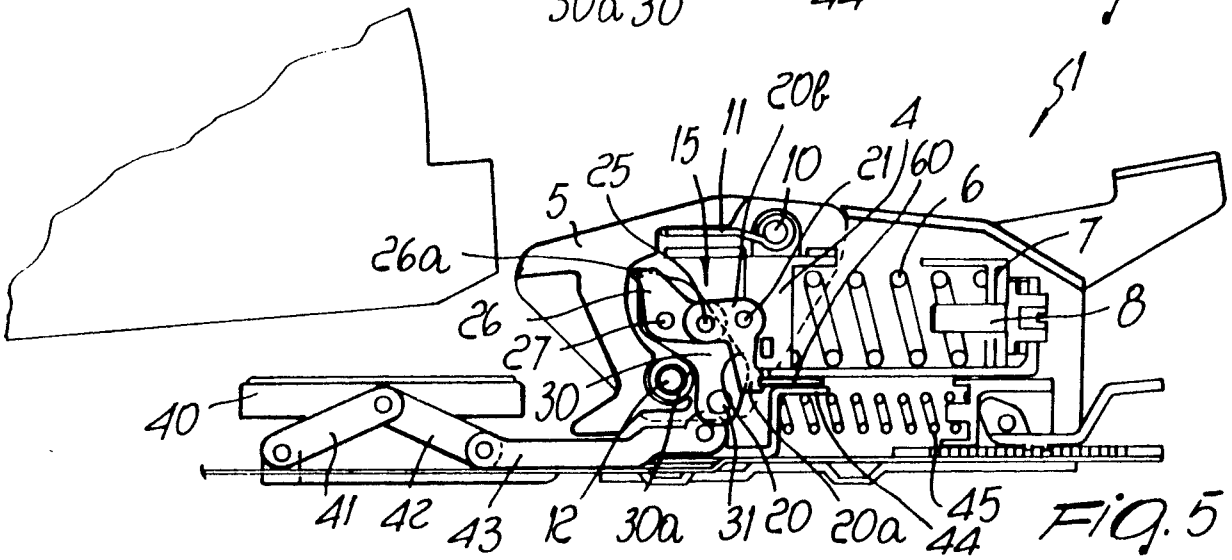
FIG. 5 is a partially sectional view of the heel unit upon the separation of a ski boot from a binding.
Figure 6:
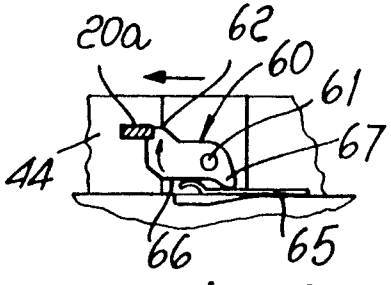
FIG. 6 is a top plan view of the arrangement of the pawl in the condition of FIG. 5.

When the ski boot 9 separates from the binding, as schematically indicated in FIG. 5, the pedal 40 is initially spaced and rises with respect to the ski by being pushed by the slider 44 because of the action of the extraction spring 45.

The kinematic system 15 is still in closed position, but the point 25 has moved toward the line which joins the points 21 and 27 and the wing 62 of the pawl 60 is in contact with the active arm 20*a* of the angular lever.

Figure 7:
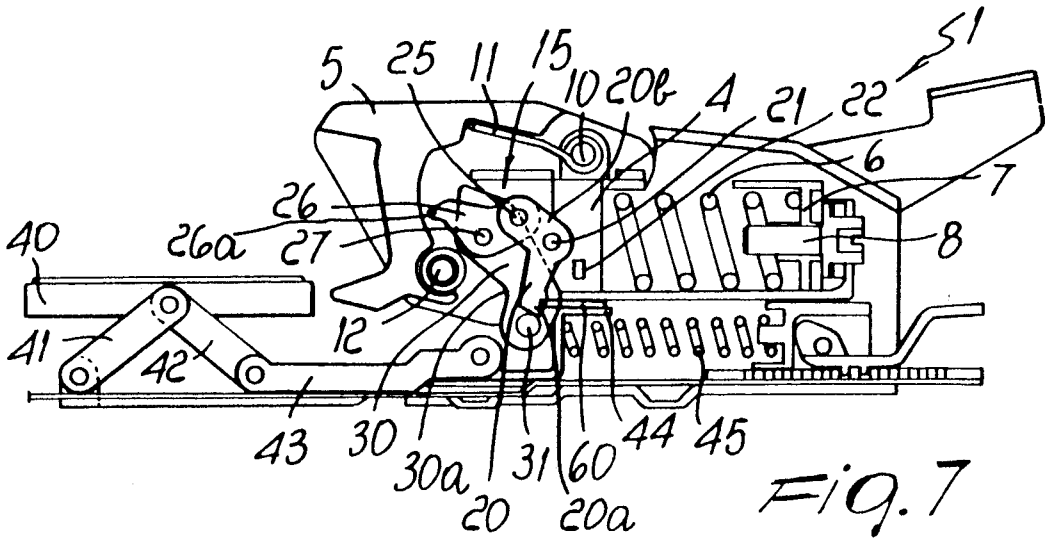
FIG. 7 is a sectional view of the opening of the rear jaw caused by the translatory motion of the slider.

As the rise of the pedal 40 continues (FIG. 7), the pawl 60, supported by the slider 44, causes the opening of the kinematic system, since the point 25 passes above the line which joins the points 21 and 27, with a consequent clockwise rotation, with reference to the drawing, of the contoured opening lever 30 which allows the grip jaw 5 to rotate so as to open.

Figure 8:
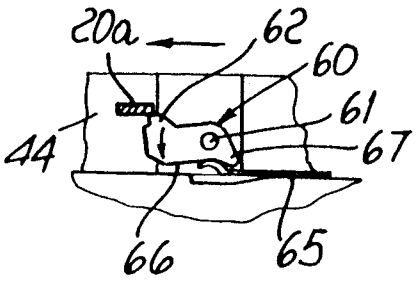
FIG. 8 is a detail view of the arrangement of the pawl.

As the translatory motion of the slider 44 continues (FIG. 8), the pawl 60 furthermore moves its return portion 67 into engagement with the elastic blade 65 so that it is rotated and leaves the region of action of the arm 20*a* of the angular lever 20.

Figure 9:
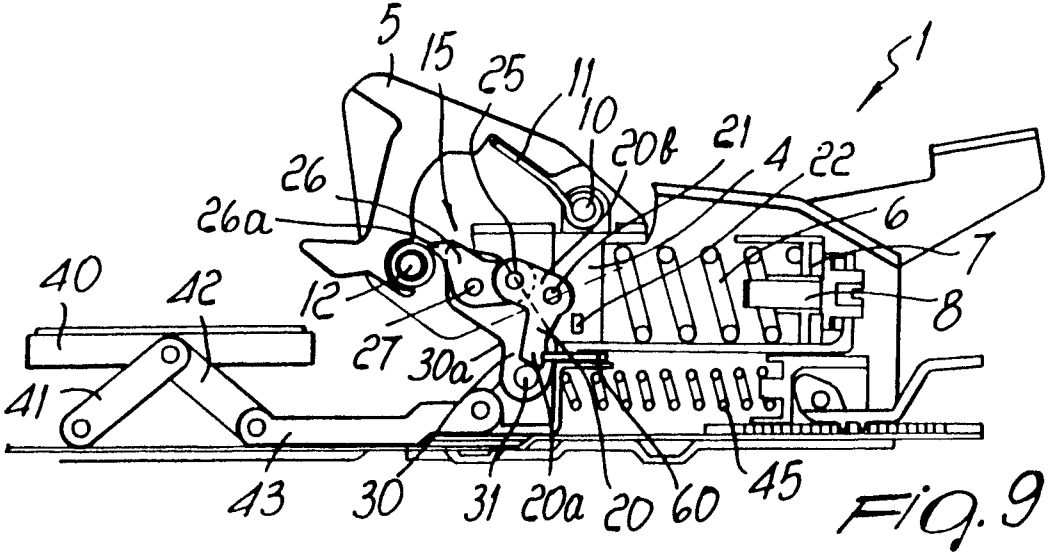
FIG. 9 is a sectional view of the heel unit with the jaw in open position at the beginning of the automatic reset step.
Figure 10:
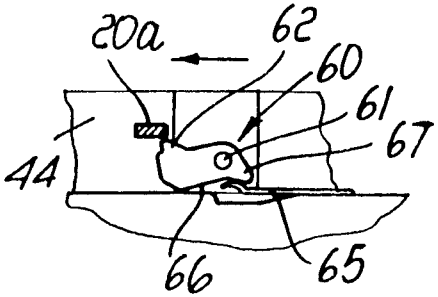
FIG. 10 is a view of the related arrangement of the pawl.
Figure 11:
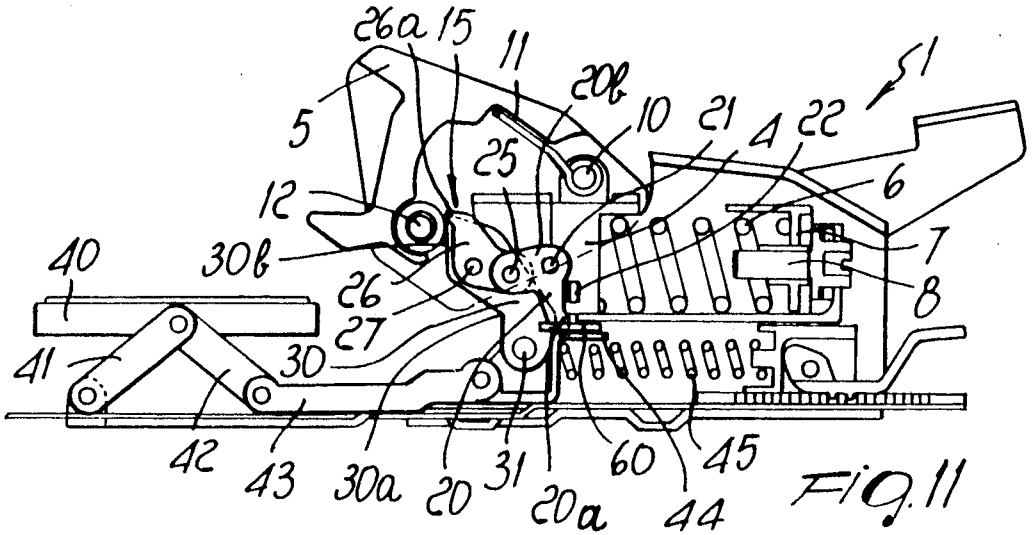
FIG. 11 is a sectional view of the heel unit with the jaw open, after automatic reset has been performed.
Figure 12:
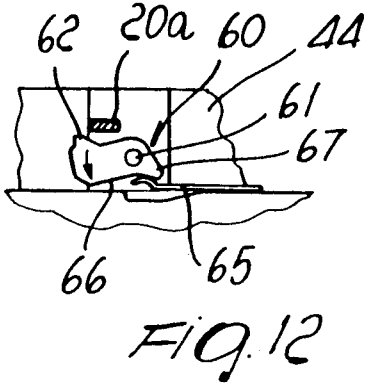
FIG. 12 is a view of the related arrangement of the pawl.

As the opening rotation of the grip jaw 5 continues (FIG. 9), the cam-follower roller 12 engages the reset wing 26*a* of the intermediate reset lever 26, causing the rotation of said reset lever 26 in the opposite direction and accordingly, as illustrated in FIG. 11, the rotation of the angular lever 20 in the opposite direction so that the point 25 rearranges itself below the line which connects the points 21 and 27. In this step (FIG. 12), the pawl 60 is in a retracted position so as to avoid hindering the rotation of the angular lever 20.

The heel unit is thus in open and reset position, i.e. ready to couple to the ski boot again.

Said reset occurs independently of the fact that the boot has been released from the binding due to the opening of the toe unit or of the heel unit; reset is in fact produced by the separation of the ski boot from the pedal, with the consequent translatory motion of the slider and occurrence of the series of actuations described above.

Figure 13:
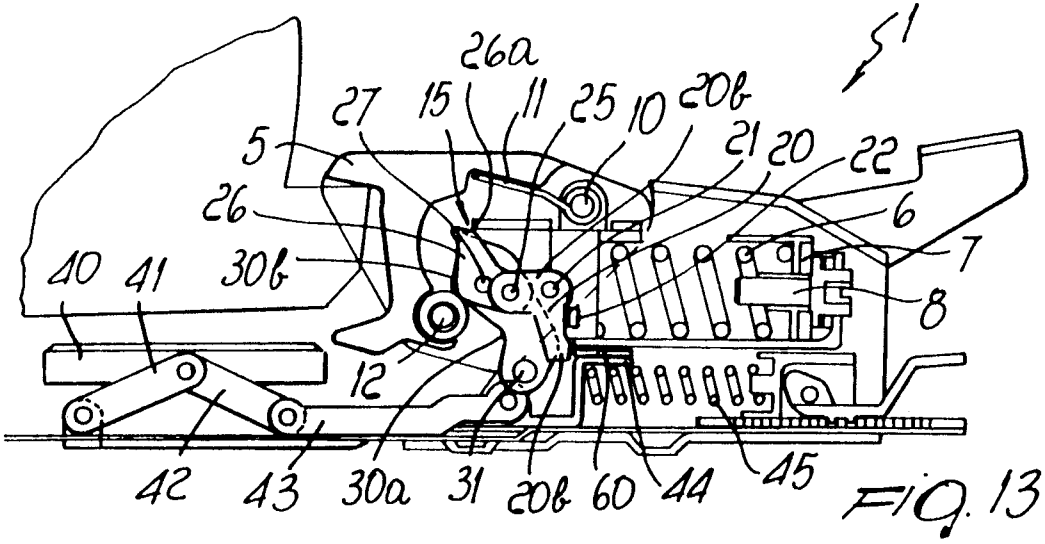
FIG. 13 is a schematic side view of the heel unit during intermediate step of a new coupling of the ski boot.
Figure 14:
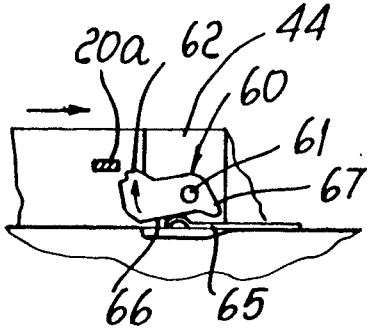
FIG. 14 is a view of the related arrangement of the pawl.

When the ski boot is repositioned (FIG. 13), the pedal lowers initially, the slider 44 consequently moves in a direction opposite to the preceding one and the pawl passes to the side of the arm 20*a* of the lever 20 until, once it has passed beyond the lever, said pawl rearranges itself in a position for possible engagement, as shown in FIG. 4

Figure 3:
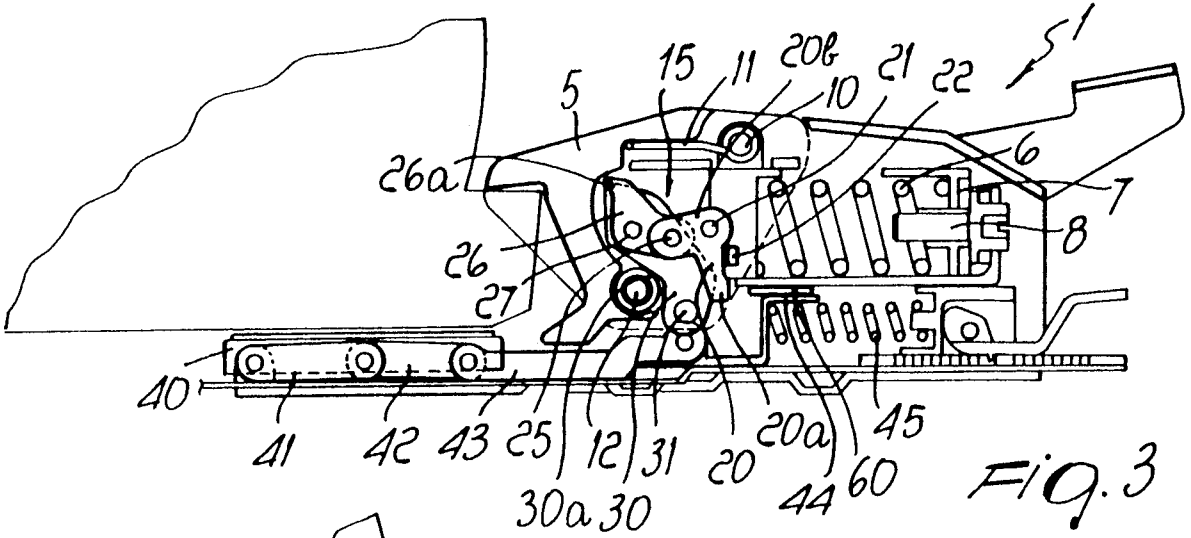
FIG. 3 is a partially sectional view of the heel unit in closed position for securing the ski boot.

The binding rearranges itself as shown in FIG. 3 once the boot has been recoupled.

From what has been described above it can thus be seen that the invention achieves the intended aim and objects, and it is noted in particular that the automatic reset actuation is performed by an element which is operatively connected to the ski boot, as is indeed the pedal 40, so that undue releases or openings cannot occur during ordinary skiing.

Furthermore, and this is an important aspect, the pedal 40 can directly actuate the ski brake as well, so that it is possible to perform a simultaneous actuation of the brake and of the automatic reset of the heel unit.

The heel unit thus conceived is susceptible to numerous modifications and variations, all of which are within the scope of the inventive concept.

All the details may furthermore be replaced with other technically equivalent elements.

In practice, the materials employed, as well as the contingent shapes and dimensions, may be any according to the requirements.

I claim:

1. Heel unit for ski bindings with automatic reset means, comprising:

a heel unit body which is connectable to a ski;

a ski boot grip jaw rotatably supported by said heel unit body for holding down a heel portion of a ski boot;

a piston element slidably carried on said heel unit body;

a kinematic system connected to said piston element for providing a releasable and adjustable retaining force on said grip jaw to retain said grip jaw in a boot securing position;

calibratable elastic means for biasing said kinematic system into contact with said grip jaw thereby to provide said releasable and adjustable retaining force; and spring-biased actuation means slidably carried on said heel unit body for engaging with said kinematic system upon separation of the heel portion of the ski boot from the heel unit thereby to automatically release said retaining force to allow said grip jaw to rotate into an open released position;

said kinematic system comprising:

a contoured opening lever with an upper end and a lower end, said lower end of said contoured opening lever being pivoted at a lower portion of said heel unit body;

an intermediate reset lever with a middle portion pivoted to said upper end of said contoured opening lever; and an angular lever having a median portion which is pivotally connected to said piston, said angular lever having an active arm for abutting, during said boot securing position, against an abutment element carried on said piston, said angular lever also having an interconnection arm which is articulated to an end of said intermediate reset lever;

said opening, intermediate, and angular levers being mutually articulated about axes which are mutually parallel and substantially transverse to a ski longitudinal lever;

said opening, intermediate, and angular levers being mutually articulated about axes which are mutually parallel and substantially transverse to a ski longitudinal axis.

2. Heel unit according to claim 1, further comprising a ski brake plate pivotally connected to said heel unit body, said spring-biased actuation means also engaging with said ski brake plate upon separation of the heel portion of the ski boot from the heel unit to automatically rotate said ski brake plate into a braking position.

3. Heel unit according to claim 1, wherein said contoured lever has an edge for engaging a cam-follower roller carried on said grip jaw, said edge comprising a securing indent which blends with an opening portion, said grip jaw being pivoted to said heel unit body about an axis which is substantially horizontal and transverse to the ski longitudinal axis.

4. Heel unit according to claim 1, wherein when said grip jaw is in said boot securing position, a point of common pivoting of the angular lever interconnection arm and of the intermediate reset lever is arranged below a line which connects a common pivoting point of said angular lever and of said intermediate reset lever to a point of common pivoting of said intermediate reset lever and of said contoured lever, and said active arm of said angular lever being in abutment against a stop element.

5. Heel unit according to claim 1, wherein said actuation means comprise a pedal which is arrangeable on the ski at a region thereof for accommodating the heel portion of a ski boot, said pedal being supported by a first lever which is pivoted, at one end, to a base of the heel unit body and, at another end, to said pedal and to a first end of a second lever which is pivoted, at a second end thereof, to an arm which can slide longitudinally along the ski, said arm being connected to a slider which is elastically pushed by elastic extraction means for exerting a trust action in a direction of a rising separation of said pedal from said ski.

6. Heel unit according to claim 1, wherein said actuation means comprise a pedal which is arrangeable on the ski at a region thereof for accommodating the heel portion of a ski boot, said pedal being supported by a first lever which is pivoted, at one end, to a base of the heel unit body and, at another end, to said pedal and to a first end of a second lever which is pivoted, at a second end thereof, to an arm which can slide longitudinally along the ski, said arm being connected to a slider which is elastically pushed by elastic extraction means for exerting a thrust action in a direction of a rising separation of said pedal from said ski, the heel unit further comprising a brake plate with braking arms which are pivoted to a point of pivoting of said contoured lever to said heel unit body and which engages a portion of either said linking arm and said slider which can slide longitudinally along the ski in order to generate a rotation and extraction of said braking arms.

7. Heel unit according to claim 1, wherein said actuation means comprise a pedal which is arrangeable on the ski at a region thereof for accommodating the heel portion of a ski boot, said pedal being supported by a first lever which is pivoted, at one end, to a base of the heel unit body and, at another end, to said pedal and to a first end of a second lever which is pivoted, at a second end thereof, to an arm which can slide longitudinally along the ski, said arm being connected to a slider which is elastically pushed by elastic extraction means for exerting a thrust action in a direction of a rising separation of said pedal from said ski, said heel unit further comprising a pawl which is pivoted, in a median portion thereof, on said slider about an axis which is substantially perpendicular to a plane of arrangement of the ski and is provided at a first side thereof with an active wing for engaging with said active arm of said angular lever.

8. Heel unit according to claim 7, wherein said pawl comprises, on a second side thereof which is opposite to said first side with said active wing, a planar thrust portion which is arranged in front of a pivoting point of the pawl, and a rear return portion which is arranged rearward with respect to the pivoting point of said pawl on the slider, the heel unit further comprising an elastic thrust blade which is supported by said heel unit body for engagement with said planar thrust portion and said rear return portion upon movement of said slider, and wherein when said slider is in a forward position, said elastic thrust blade engages said pawl return wing so as to disengage said pawl from a region of oscillation of the active arm of said angular lever.

9. Heel unit according to claim 1, wherein said actuation means comprise a pedal which is arrangeable on the ski at a region thereof for accommodating the heel portion of a ski boot, said pedal being supported by a first lever which is pivoted, at one end, to a base of the heel unit body and, at another end, to said pedal and to a first end of a second lever which is pivoted, at a second end thereof, to an arm which can slide longitudinally along the ski, said arm being connected to a slider which is elastically pushed by elastic extraction means for exerting a thrust action in a direction of a rising separation of said pedal from said ski, and wherein when said grip jaw is in said securing position, said pedal is lowered and said extraction spring is compressed to a maximum value thereof, and said kinematic system is in a closed position and a point of common pivoting of the angular lever and of the intermediate reset lever is arranged below a line which connects a point of common pivoting of the angular lever and of the intermediate reset lever to a point of common pivoting of the intermediate reset lever and of the contoured lever.

10. Heel unit according to claim 1, wherein said actuation means comprise a pedal which is arrangeable on the ski at a region thereof for accommodating the heel portion of a ski boot, said pedal being supported by a first lever which is pivoted, at one end, to a base of the heel unit body and, at another end, to said pedal and to a first end of a second lever which is pivoted, at a second end thereof, to an arm which can slide longitudinally along the ski, said arm being connected to a slider which is elastically pushed by elastic extraction means for exerting a thrust action in a direction of a rising separation of said pedal from said ski, said heel unit further comprising a pawl which is pivoted, in a median portion thereof, on said slider about an axis which is substantially perpendicular to a plane of arrangement of the ski and is provided at a first side thereof with an active wing for engaging with said active arm of said angular lever, and wherein said boot grip jaw is in said securing position said wing of the pawl is spaced, by a preset extent, from said active arm of said angular lever.

11. Heel unit according to claim 1, wherein said actuation means comprise a pedal which is arrangeable on the ski at a region thereof for accommodating the heel portion of a ski boot, said pedal being supported by a first lever which is pivoted, at one end, to a base of the heel unit body and, at another end, to said pedal and to a first end of a second lever which is pivoted, at a second end thereof, to an arm which can slide longitudinally along the ski, said arm being connected to a slider which is elastically pushed by elastic extraction means for exerting a thrust action in a direction of a rising separation of said pedal from said ski, said heel unit further comprising a pawl which is pivoted, in a median portion thereof, on said slider about an axis which is substantially perpendicular to a plane of arrangement of the ski and is provided at a first side thereof with an active wing for engaging with said active arm of said angular lever, and wherein when said ski boot separates from the heel unit, said slider moves longitudinally, said wing of said pawl engages said active arm of said angular lever, the kinematic system opens and the jaw accordingly opens since a point of common pivoting of the angular lever and of the intermediate reset lever passes beyond a line which connects a point of common pivoting of said angular lever and of said intermediate reset lever and a point of common pivoting of said intermediate reset lever and of said contoured lever.

12. Heel unit according to claim 1, wherein said contoured lever has an edge for engaging a cam-follower roller carried on said grip jaw, said edge comprising a securing indent which blends with an opening portion, said grip jaw being pivoted to said heel unit body about an axis which is substantially horizontal and transverse to the ski longitudinal axis, and wherein said intermediate reset lever has a reset wing for engaging said cam-follower roller during a final opening step of rotation of the grip jaw in order to generate a reverse rotation of said reset lever when a point of common pivoting of the reset lever and of the angular lever passes below a line which connects a point of pivoting of the angular lever to said intermediate reset lever and a point of common pivoting of said intermediate reset lever and of said contoured lever.

* * * * *